US011052299B2

(12) United States Patent
Pelechosky

(10) Patent No.: US 11,052,299 B2
(45) Date of Patent: Jul. 6, 2021

(54) REVERSIBLE SIGHTING PUTTER

(71) Applicant: Tough Guy Enterprises Inc.

(72) Inventor: Donald S. Pelechosky, Cold Lake (CA)

(73) Assignee: Tough Guy Enterprises Inc., Calgary (CA)

( * ) Notice: Subject to any disclaimer, the term of this patent is extended or adjusted under 35 U.S.C. 154(b) by 0 days.

(21) Appl. No.: 16/518,306

(22) Filed: Jul. 22, 2019

(65) Prior Publication Data

US 2020/0023259 A1 Jan. 23, 2020

(51) Int. Cl.

| | |
|---|---|
| ***A63B 53/04*** | (2015.01) |
| ***A63B 69/36*** | (2006.01) |
| ***A63B 53/06*** | (2015.01) |
| *A63B 47/02* | (2006.01) |

(52) U.S. Cl.

CPC ..... *A63B 69/3685* (2013.01); *A63B 53/065* (2013.01); *A63B 47/02* (2013.01); *A63B 53/0437* (2020.08); *A63B 53/0441* (2020.08)

(58) Field of Classification Search

CPC ... A63B 47/02; A63B 69/3685; A63B 53/065; A63B 53/0437; A63B 53/0441; A63B 1/00; A63B 2209/08; A63B 2209/00

See application file for complete search history.

(56) References Cited

U.S. PATENT DOCUMENTS 1,556,062 A * 10/1925 Baugh ..... A63B 69/3685 356/255
3,273,891 A * 9/1966 Grim, Jr. ..... A63B 69/3685 473/240
3,392,977 A * 7/1968 De Lacey ..... A63B 53/007 473/306
3,403,912 A * 10/1968 Maroun ..... A63B 69/3685 473/240
3,727,919 A * 4/1973 Scott ..... A63B 69/3685 473/240
4,413,824 A * 11/1983 King ..... A63B 69/3685 473/240
4,844,468 A * 7/1989 Lee ..... A63B 69/3685 473/240
5,052,690 A * 10/1991 Sharp ..... A63B 69/3685 473/240

(Continued)

FOREIGN PATENT DOCUMENTS

GB 223044 A * 10/1924 ..... A63B 69/3685
KR 20030088155 A * 11/2003
WO WO-9641659 A1 * 12/1996 ..... A63B 69/3685

*Primary Examiner* — Stephen L Blau
(74) *Attorney, Agent, or Firm* — Michael D. Eisenberg

(57) ABSTRACT

A golf putter that enables dual configuration, namely sighting & play modes whereby the golfer can view both the ball and the hole by means of a mirrored surface, but which is reversible so that the golfer can play within tournament rules. A removable mirrored training aid has a reflective side and can be removed, flipped to a non-reflective side, or simply replaced with a same-weighted non-reflective plate, for use in actual (non-practice) golf play. The golfer can practice his or her stroke while observing the image of the ball and hole in the mirror, and thereby imprinting the correct stroke mechanics into muscle memory. Then, after the golfer has reversed the re-attachable mirrored surface plate to present its non-reflective side, the golfer can use the putter in a round of golf.

8 Claims, 8 Drawing Sheets

(56) References Cited

U.S. PATENT DOCUMENTS

| | | | | | |
|---|---|---|---|---|---|
| 5,116,047 | A | * | 5/1992 | Phelan | A63B 53/02 473/307 |
| 5,709,612 | A | * | 1/1998 | Salado | A63B 69/3685 473/240 |
| 5,846,140 | A | * | 12/1998 | Hoburg | A63B 69/3685 473/240 |
| 5,916,035 | A | * | 6/1999 | Caiozzo | A63B 53/0487 473/252 |
| 6,095,930 | A | * | 8/2000 | Siddall | A63B 69/3685 473/240 |
| 7,364,514 | B2 | * | 4/2008 | Yamaguchi | A63B 53/0487 473/340 |
| D590,034 | S | * | 4/2009 | Foster | D21/744 |
| D603,006 | S | * | 10/2009 | Foster | D21/736 |
| D641,441 | S | * | 7/2011 | Hilton | D21/743 |
| D688,341 | S | * | 8/2013 | Rollinson | D21/746 |
| D759,172 | S | * | 6/2016 | Rollinson | D21/743 |
| D773,573 | S | * | 12/2016 | Abbott | D21/744 |
| D807,453 | S | * | 1/2018 | Serrano | D21/743 |
| D855,132 | S | * | 7/2019 | Schweigert | D21/759 |
| D860,356 | S | * | 9/2019 | Rollinson | D21/744 |
| 2011/0092306 | A1 | * | 4/2011 | Lee | A63B 53/0487 473/240 |
| 2019/0224553 | A1 | * | 7/2019 | Schiel | A63B 53/0487 |

* cited by examiner

REVERSIBLE SIGHTING PUTTER

FIELD OF THE INVENTION

This invention relates to a novel device in the general field of a training aid for golf, and more specifically to a reversible sighting putter that allows a golfer to directly sight the target hole while addressing the ball, and the ability to mask the non-legal sighting mirror during tournament play.

BACKGROUND OF THE INVENTION

While there are detachable mirrored sighting devices for putters in the prior art, they are cumbersome, distracting and need adjustment every time they are re-installed. There are also putters with mirrors integrated into the head of the putter in the prior art, but tournament or course regulations may prohibit their use during play. A putter is needed with a mirrored training aid that enables the golfer to see the hole on the green, while at the same time being able to see an adjacent image of the ball, in order to allow practice swings that embed correct stroke mechanics, and which also should be easily removable or reversible to allow legal play where required.

BRIEF SUMMARY OF THE INVENTION

The novel device is a golf putter that enables dual configuration, namely sighting & play modes whereby the golfer can view both the ball and the hole by means of a mirrored surface, but which is reversible so that the golfer can play within tournament rules. By this means, the golfer can practice his or her stroke while observing the image of the ball and hole in the mirror, and thereby imprinting the correct stroke mechanics into muscle memory. Then, after the golfer have reversed the re-attachable mirrored surface plate to present its non-reflective side, the golfer can make the putting stroke in an actual round of golf.

Essentially, the invention provides a golf putter having a shaft, a putter head, and a removable mirrored training aid plate on the putter head, the removable mirrored training aid being able to reflect an image of both a golf ball on a practice putting green and a target hole on the putting green upwards along the shaft to a golfer viewing the image for putting practice. The removable mirrored training aid plate can have both a reflective side and a non-reflective side and is reversible in its position in the putter head to enable elimination of reflecting an image upward along the shaft, to allow legal play with the putter during a round of golf.

Alternatively, the golf putter can further comprise multiple replacment plates, including a completely non-reflecting plate for replacement of the removable mirrored training aid plate on the putter head, during actual golf play in compliance with official or tournament rules, the non-reflecting plate having the same weight, shape and balance as the removable mirrored training aid plate.

In a preferred embodiment the removable mirrored training aid plate has ferrous inserts that align with magnets on a plate receiver area on the putter head, and the putter head has a cambered bottom, a right counterweight leaf and a left counterweight leaf, a ball lift notch, a sight groove aligned with a centre of the removable mirrored training aid plate;

The invention can be provided without an integrated shaft, for attachment to either a left-handed or a right-handed putter shaft, by providing the putter head has a right shaft hole and a left shaft hole embedded in a top surface of the putter head, to enable the putter head to receive a right-handed or a left-handed shaft respectively.

DETAILED DESCRIPTION

All elements will now be introduced by reference to disclosed figures, and where relevant, how each element functions and interacts with each other element will be described.

Figure 1:
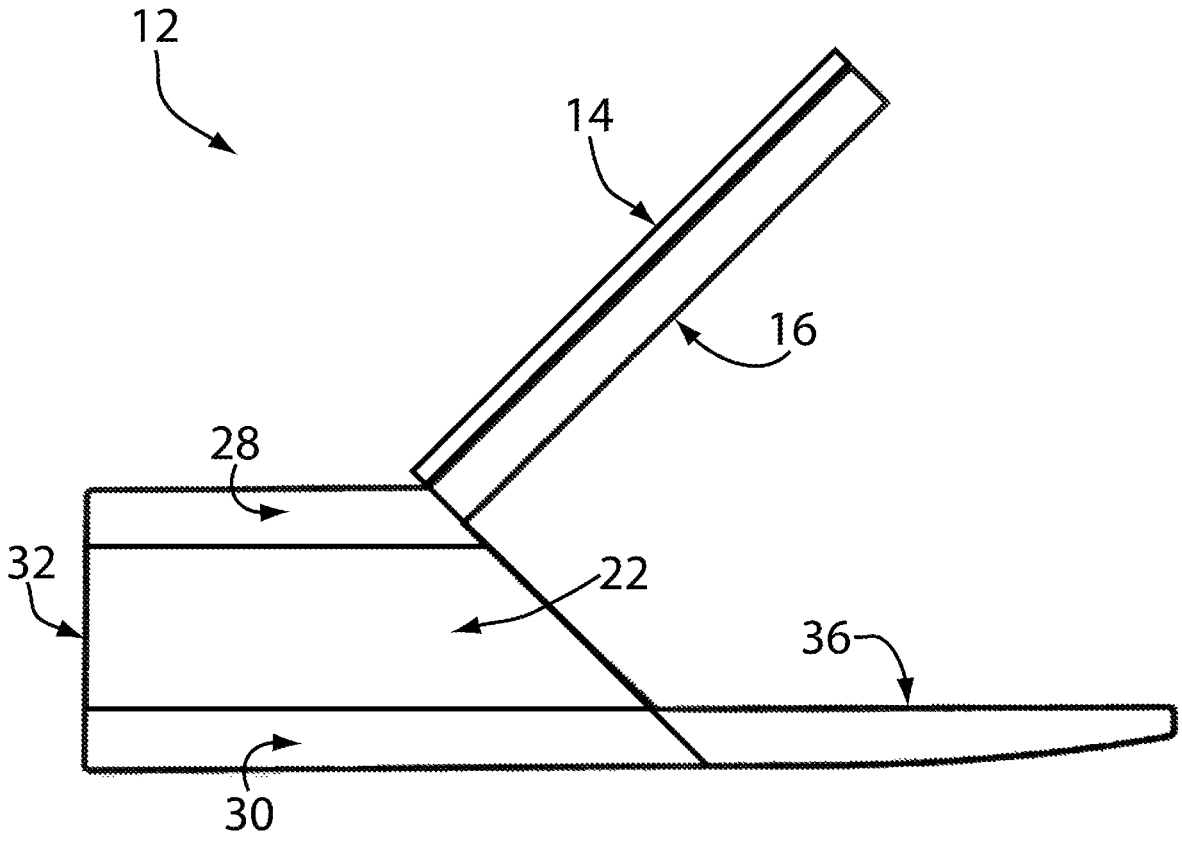
FIG. 1 shows a left side view of the putter head without its shaft.

FIG. 1 shows a left side view of the putter head 12 which includes a reversible plate 14 and plate receiver 16. Also visible are the left side 22, top left bevel 28, bottom left bevel 30, face 32, and left counterweight leaf 36.

Figure 2:
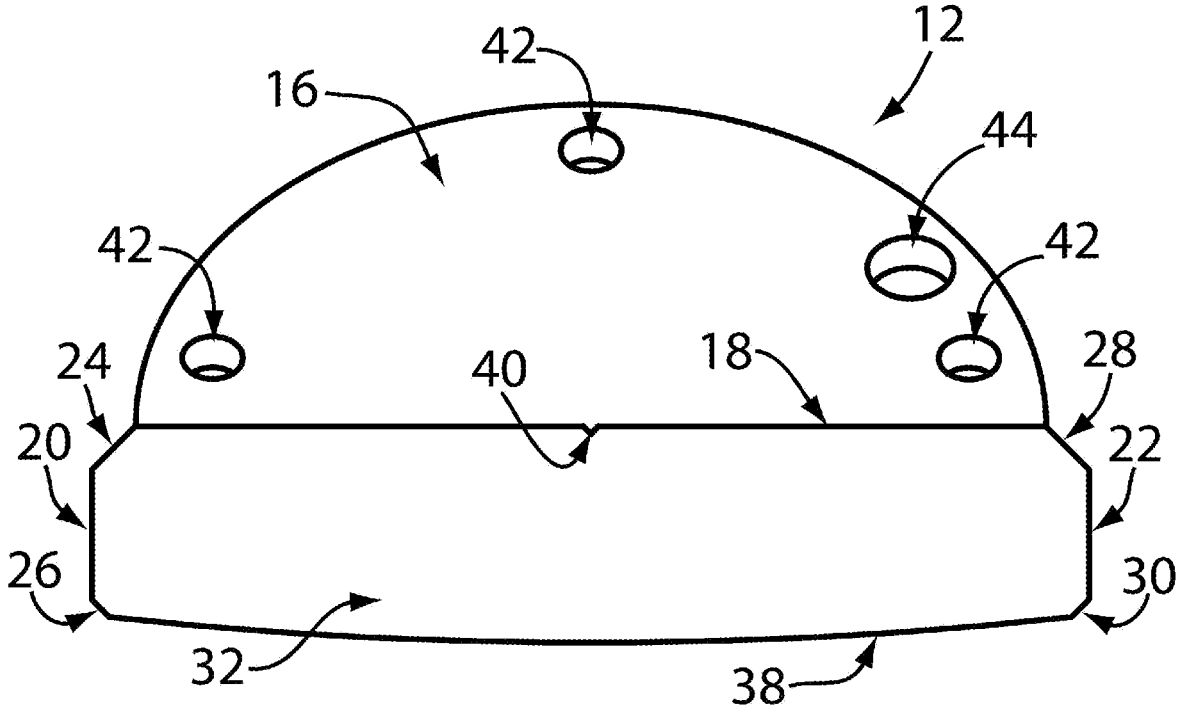
FIG. 2 shows a front facing view of the putter head without shaft, reversible plate or magnets.

FIG. 2 shows a front facing view of the putter head 12, plate receiver 16, top surface 18, right side 20, right top bevel 24, right bottom bevel 26, left side 22, left top bevel 28, left bottom bevel 30, face 32, cambered bottom 38, sight groove 40, magnet holes 42, and extraction hole 44.

Figure 3:
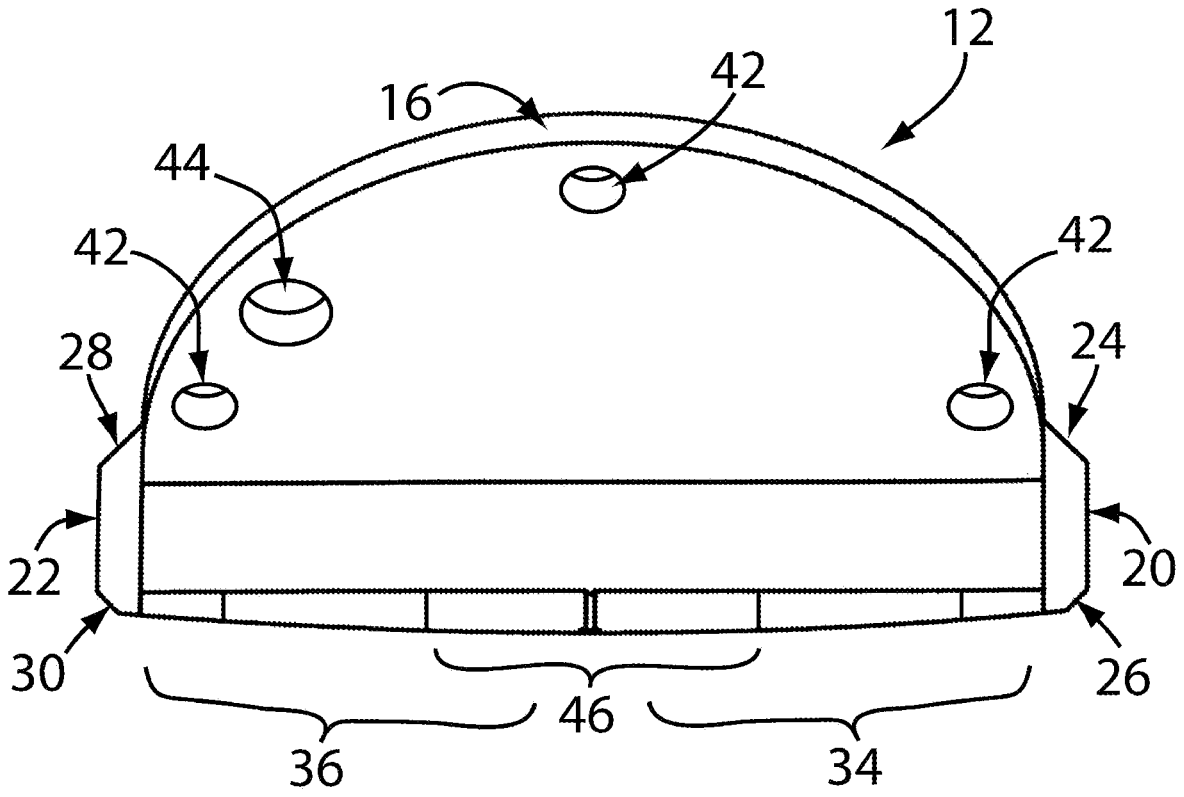
FIG. 3 shows a rear view of the putter head as shown in FIG. 2.

FIG. 3 shows a rear view of the putter head 14 as shown in FIG. 2, including a right counterweight leaf 34, left counterweight leaf 36, and ball lift notch 46.

Figure 4A:
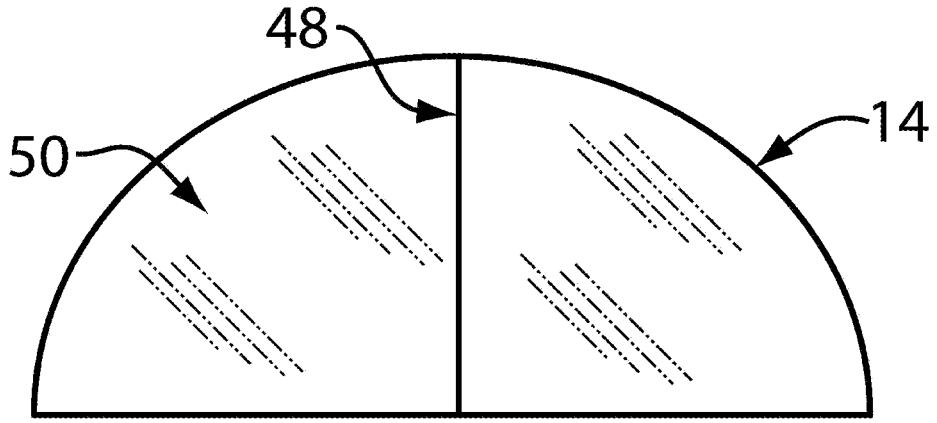
FIG. 4*a* shows a facing mirrored surface side of the reversible plate.
Figure 4B:
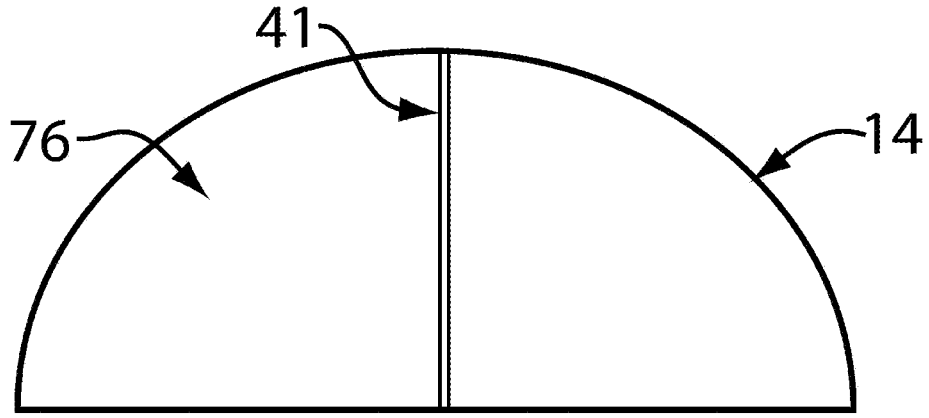
FIG. 4*b* shows a facing non-mirrored surface side of same.
Figure 4C:
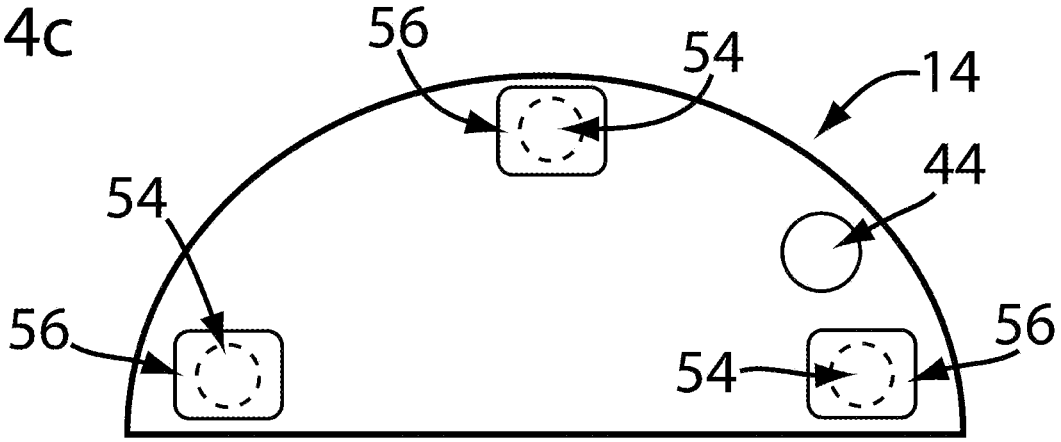
FIG. 4*c* shows a cutaway view of the reversible plate and the alignment of ferrous inserts with magnets on the plate receiver.

FIG. 4*a* shows a facing mirrored surface 50 side of the reversible plate 14, including a sight line 48. FIG. 4*b* shows a facing non-mirrored surface 76 side of same reversible plate 14, including a plate sight groove 41. FIG. 4*c* shows a facing cutaway view of the reversible plate 14 and the alignment of its ferrous inserts 56 with corresponding magnets 54 embedded in the plate receiver 16 (broken circles).

Figure 5:
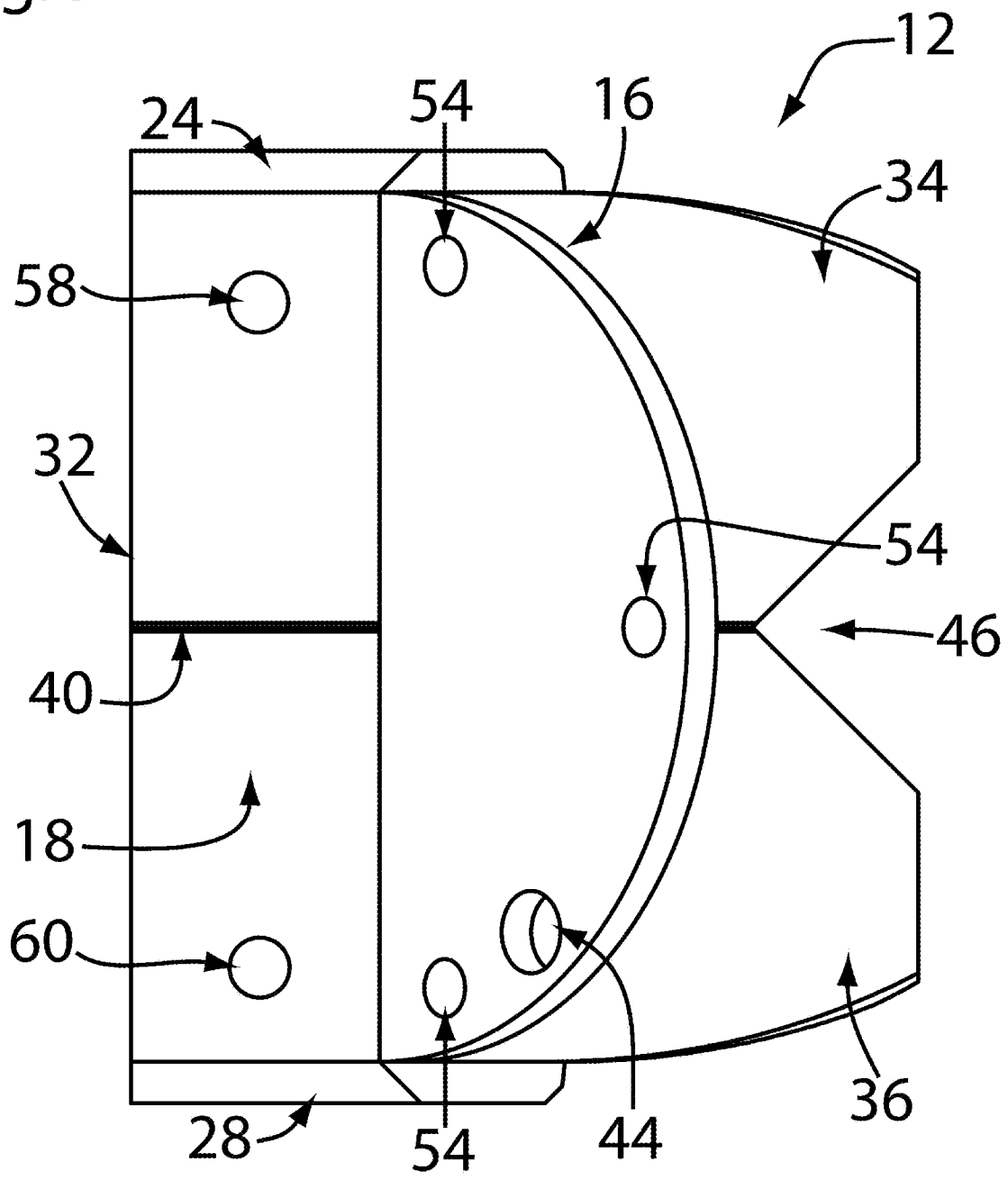
FIG. 5 shows a top left facing view of a putter head without reversible plate or shaft.

FIG. 5 shows a top left-facing view of a putter head 12 without reversible plate 14 or shaft 62, and including magnets 54 embedded in the corresponding magnet holes of the plate receiver 16 shown in FIG. 2. Also visible are the right shaft hole 58 and the left shaft hole 60 embedded in the top surface 18 of the putter head 12 to receive either a right or left handed shaft 62 (shown in FIG. 6).

Figure 6:
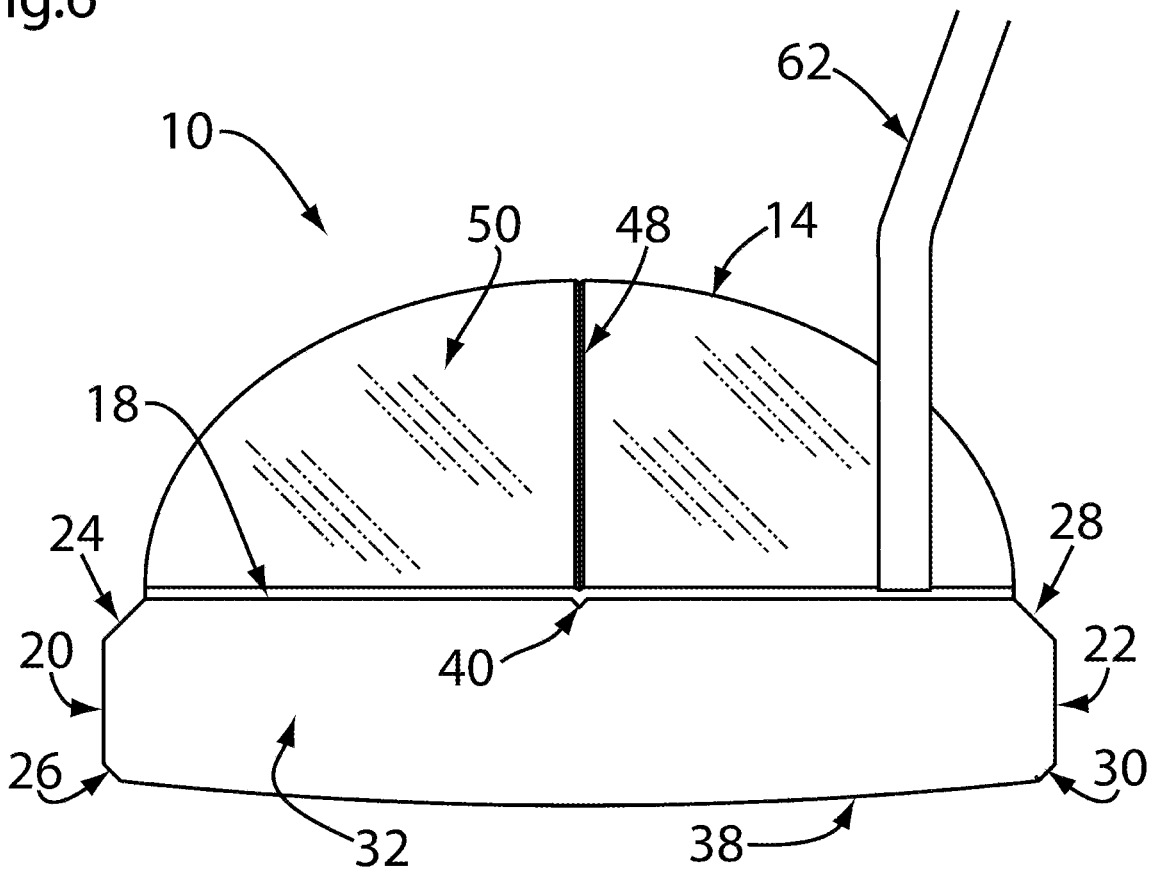
FIG. 6 shows a front facing view of a Reversible Sighting Putter in its Sighting Mode.

FIG. 6 shows a front facing view of a Reversible Sighting Putter 10 with the mirrored surface 50 of the reversible plate 14 attached in position.

Figure 7A:
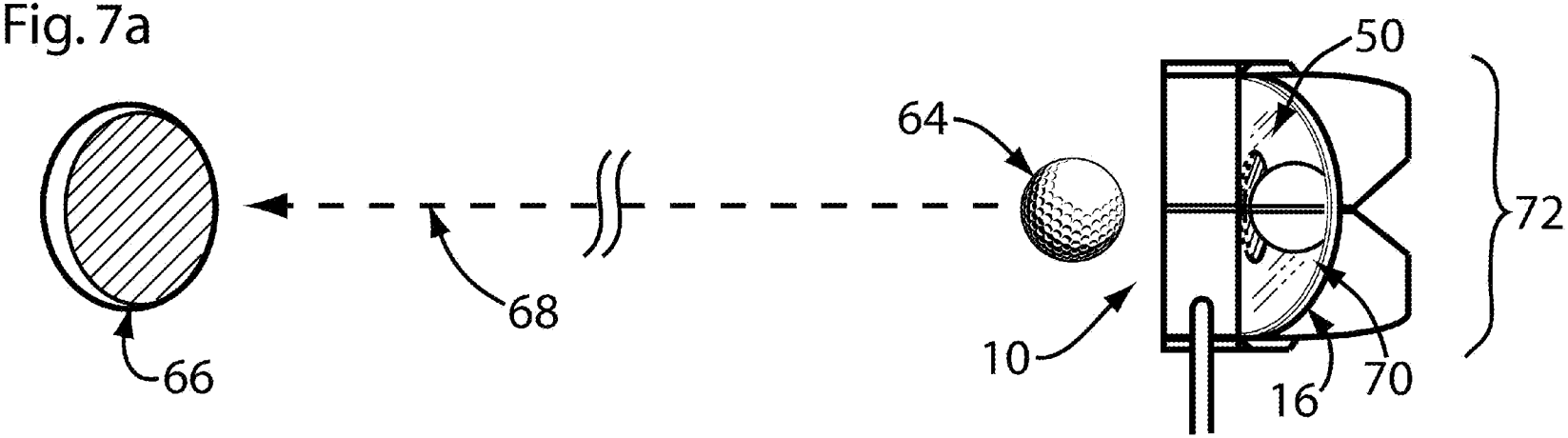
FIGS. 7*a* and 7*b* show top views of the Reversible Sighting Putter as used on a green, in sighting & play modes, respectively.
Figure 7B:
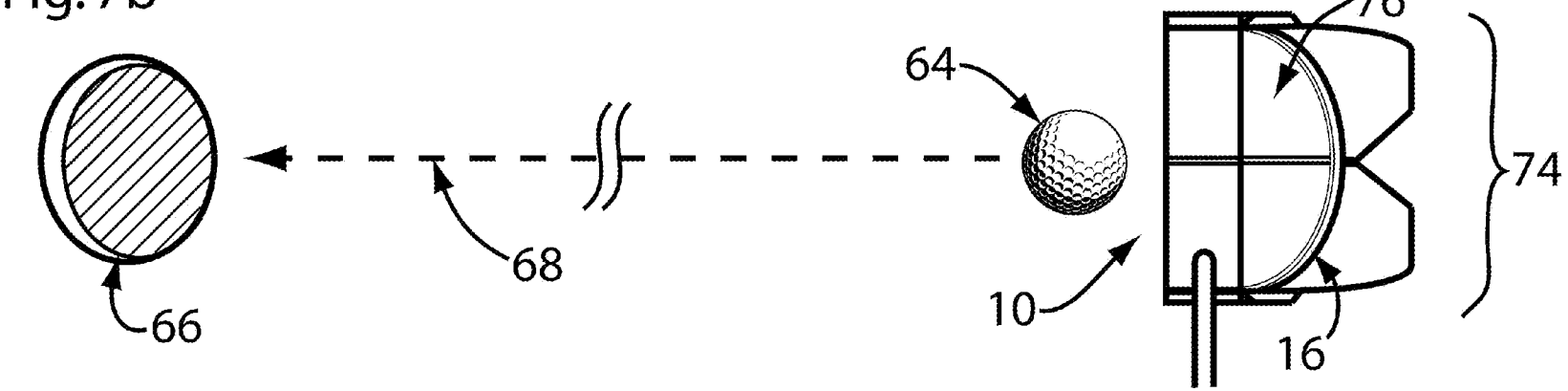

FIGS. 7*a* and 7*b* show top views of the Reversible Sighting Putter 10 as used on a putting green, in sighting 72 & play 74 modes, respectively. In sighting mode 72, the combined (ball/hole) image 70 is visible in the mirrored surface 50, while the golfer practices his stroke of the ball 64 along its path 68 towards the hole 66. In play mode 74, the plate is reversed to present the non-reflective surface 76, in order to permit legal play.

Figure 8:
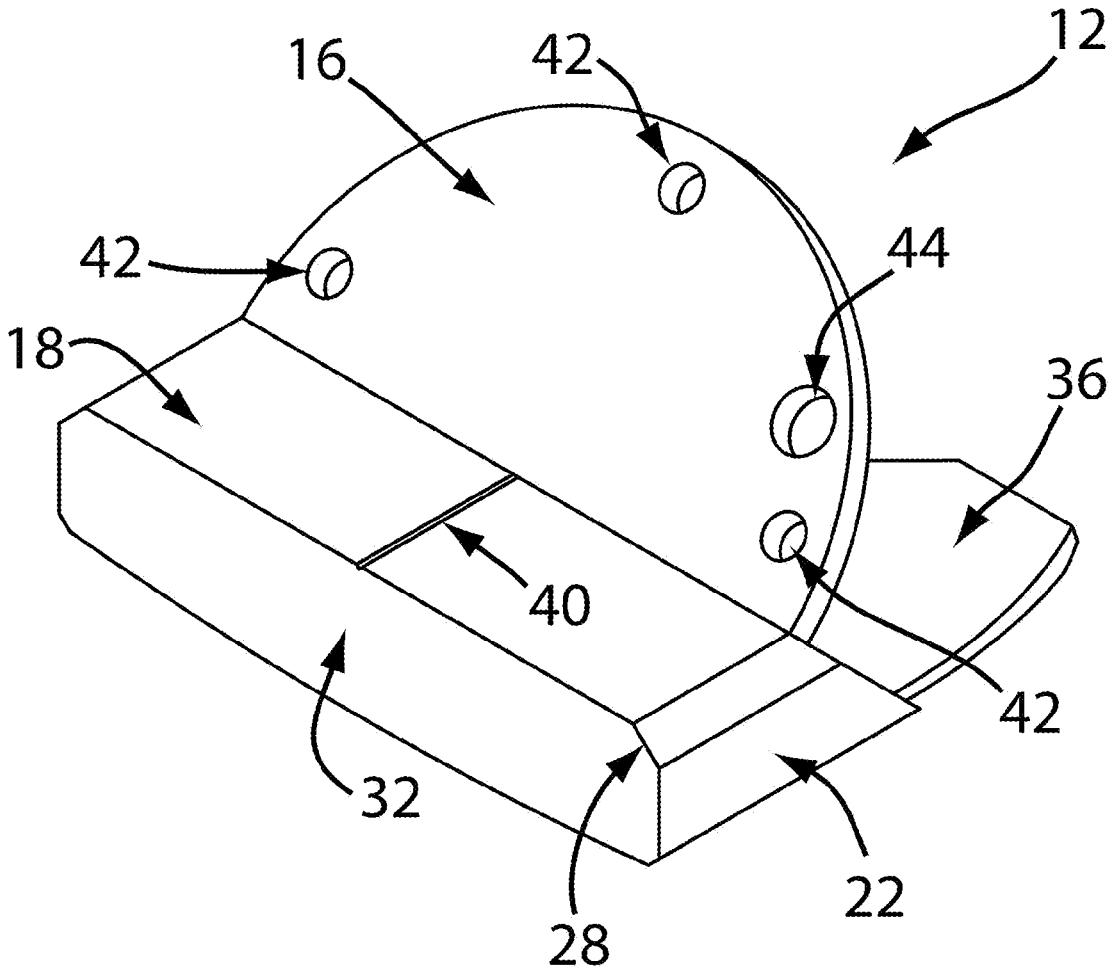
FIG. 8 shows a front isometric view of the putter head.

FIG. 8 shows a front isometric view of the putter head body 12.

The preferred embodiment of the Reversible Sighting Putter 10 will now be described in detail. The novel putter 10 enables the golfer to switch from a training aid configuration (sighting mode 72) to play mode 74 by switching the side of the reversible plate 14 with a mirrored surface 50, to a non-reflective surface 76 (see FIG. 4*ab*). In play mode 74, the non-reflective surface 76 of the reversible plate 14 is on the outside. To switch to sighting mode 72, the reversible plate 14 is released from the attraction of the magnets 54 in the receiver 16 and the ferrous inserts 56 in the plate 14 by pushing at the back of the plate 14 through the extraction hole 44 until the plate 14 is released. The plate 14 is then reversed and reseated onto the receiver 16, its flat bottom aligned to the putter's top surface 18 and its body reattached to the receiver 16 by the same embedded magnets 54, so that the mirrored surface 50 is available for sighting mode 72 practice. The reversible plate 14 and plate receiver 16 should be flush with each other, and may be aligned by touch and by aligning the plate's sight line 48 with the putter head's 12 sight groove 40. If in play mode 74, align using the plate sight groove 41 and the putter head's 12 sight groove 40.

The plate receiver 16 is positioned at a 45 degree angle to the putter shaft 62, therefore the mirrored surface 50 of the reversible plate 14 is also at this angle when secured into the receiver 16 in the sighting mode 72. The golfer sights the hole 66 by looking downwards towards the putter head 12, parallel to the shaft 62. The mirrored surface 50 of the reversible plate 14 reflects a combined image 70 of the ball 64 and the path 68 to the hole 66, back up the shaft 62 to the golfer. The combined image 70 of the ball 64 and distant hole on green 66 (sighting mode 72) allows the player to visualize the correct alignment, and then practice appropriate swings in preparation for play mode 72. (see FIGS. 7*a* & *b*)

A key advantage of the reversible sighting putter 10 is that there is no weight or balance change when switching from sighting mode 72 to play mode 74, or visa versa. In prior art designs, the golfer must remove sighting apparatus to allow legal putting, but in the present design, reversing the plate 14 in the receiver 16 enables either mode on the putter head 12, as the plate 14 remains attached in the same position and of the same weight and balance. The golfer can practice his putting in sighting mode 72 in a variety of putting green situations, while having the same putter shape, balance and weight for legal putting in play mode 74.

The reversible sighting putter 10 design is performance driven, with the goal of improving 3 to 6 foot putts and generating a precision pendulum feel by means of keeping consistent balance throughout modes. The sighting mode 72 allows the golfer to practice proper positioning, stance, alignment, balance and follow through. The golfer can train his or her muscle memory by visual confirmation of both ball and hole in one glance, while practicing a putting stroke as many times as it takes to improve hand/eye coordination, proprioception, and confidence.

Other embodiments of the reversible sighting putter 10 will be described in detail. Additional embodiments are not ruled out or similar methods leading to the same result. The reversible plate 14 may be constructed entirely of ferrous metal (to attach to magnets on receiver 16) with one side mirrored as before. The putter head may alternately use multiple plates, one mirrored with a metal back, and one non-reflecting to meet competition rules, also with a metal back. Each plate should be of similar weight and balance so as to retain putter head stroke consistency.

The preferred materials for constructing the reversible sighting putter 10 will now be described. The reversible plate 14 can be made of light durable plastic or similar material with embedded ferrous inserts 56 and a mirrored surface 50. The putter head 12 and shaft 62 will be constructed of similar metals and other materials that are commonly used in the golfing industry to allow precise balance and pendulum effect of competition level putters and training aids, including, but not limited to steel, stainless, copper, brass, titanium, carbon fiber, or any combination thereof.

Other advantages of using the reversible sighting putter 10 over other methods or devices will now be described. The mode switching capability integrated into the putter head of the present design helps eliminate trigger points of distraction as compared to prior art employing more complicated and less streamlined sighting devices. Shape and weight distribution of putter head with onboard reversible training aid enables consistent feel during play and practice. Present design enables simultaneous awareness of ball & hole position, improved muscle memory training, and higher confidence when putting under pressure.

The foregoing description of the preferred apparatus and method of implementation should be considered as illustrative only, and not limiting. Other forming techniques and other materials may be employed towards similar ends. Various changes and modifications will occur to those skilled in the art, without departing from the true scope of the invention as defined in the above disclosure, and the following general claims.

I claim:

1. A golf putter having a shaft, a putter head, and a removable mirrored training aid plate on the putter head, the removable mirrored training aid plate being able to reflect an image of both a golf ball on a practice putting green and a target hole on the putting green upwards along the shaft to a golfer viewing the image for putting practice, in which the removable mirrored training aid plate has both a reflective side and a non-reflective side and is reversible in its position in the putter head to enable elimination of reflecting an image upward along the shaft, to allow legal play with the putter during a round of golf, and in which the removable mirrored training aid plate has ferrous inserts that align with magnets on a plate receiver area on the putter head.

2. The golf putter of claim 1, further comprising a counterweight leaf for optimal balance of the head on the shaft.

3. The golf putter of claim 1, in which the putter head has a cambered bottom.

4. The golf putter of claim 1, in which the putter head has a sight groove.

5. The golf putter of claim 4, in which the sight groove is aligned with a centre of the removable mirrored training aid plate.

6. The golf putter of claim 1, further comprising a right counterweight leaf, a left counterweight leaf, and a ball lift notch.

7. The golf putter head of claim 1, in which the putter head has a right shaft hole and a left shaft hole embedded in a top surface of the putter head, to enable the putter head to receive a right-handed or a left-handed shaft respectively.

8. The golf putter of claim 1, in which the putter head has a cambered bottom and a right counterweight leaf and a left counterweight leaf, a ball lift notch, a sight groove aligned with a centre of the removable mirrored training aid plate.

* * * * *